United States Patent [19]

Marin et al.

[11] 4,022,457

[45] May 10, 1977

[54] SHEET FOLDING DEVICE

[75] Inventors: M. James Marin, South Norwalk; Ferris Gene Keyt, Trumbull, both of Conn.

[73] Assignee: Pitney-Bowes, Inc., Stamford, Conn.

[22] Filed: June 9, 1975

[21] Appl. No.: 584,871

[52] U.S. Cl. ..... 270/86; 270/94

[51] Int. Cl.[2] ..... B65H 45/22

[58] Field of Search ..... 270/61 F, 64–66, 270/79, 86–94; 223/32, 34; 93/84 R

[56] References Cited

UNITED STATES PATENTS

| | | | |
|---|---|---|---|
| 2,282,126 | 5/1942 | Gabbert | 270/66 |
| 2,956,799 | 10/1960 | Wasson | 270/86 |
| 3,534,953 | 10/1970 | Appleby | 270/86 |
| 3,570,841 | 3/1971 | Rettig | 270/64 |
| 3,701,522 | 10/1972 | Chi | 270/86 |
| 3,774,903 | 11/1973 | Sjoman | 270/86 |
| 3,917,255 | 11/1975 | Watrous | 270/86 |

*Primary Examiner*—Edgar S. Burr
*Assistant Examiner*—A. Heinz
*Attorney, Agent, or Firm*—Albert W. Scribner; William D. Soltow, Jr.; Martin D. Wittstein

[57] ABSTRACT

A system for progressively folding a sheet as it continuously moves along a feed path from a printer to an envelope inserting station; said system including an arrangement for initially forming longitudinal score lines on a sheet and for then progressively laterally bending and creasing the sheet along said score lines to as to form a folded sheet having a plurality of mutually overlying panels. The scoring and lateral bending operations take place in a progressive manner as the sheet continuously moves along its substantially linear feed path.

5 Claims, 5 Drawing Figures

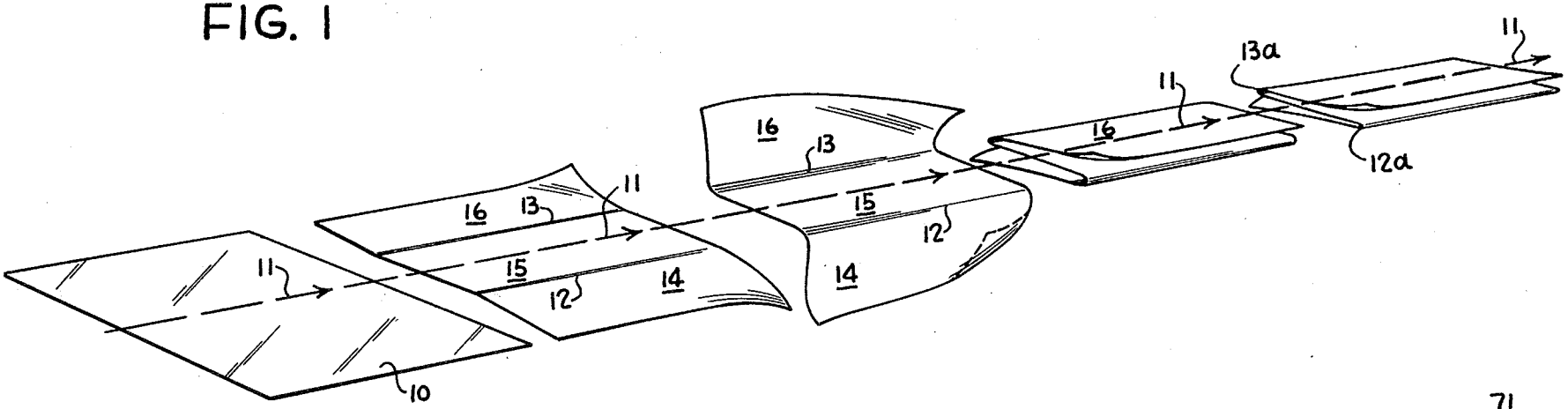
FIG. 1
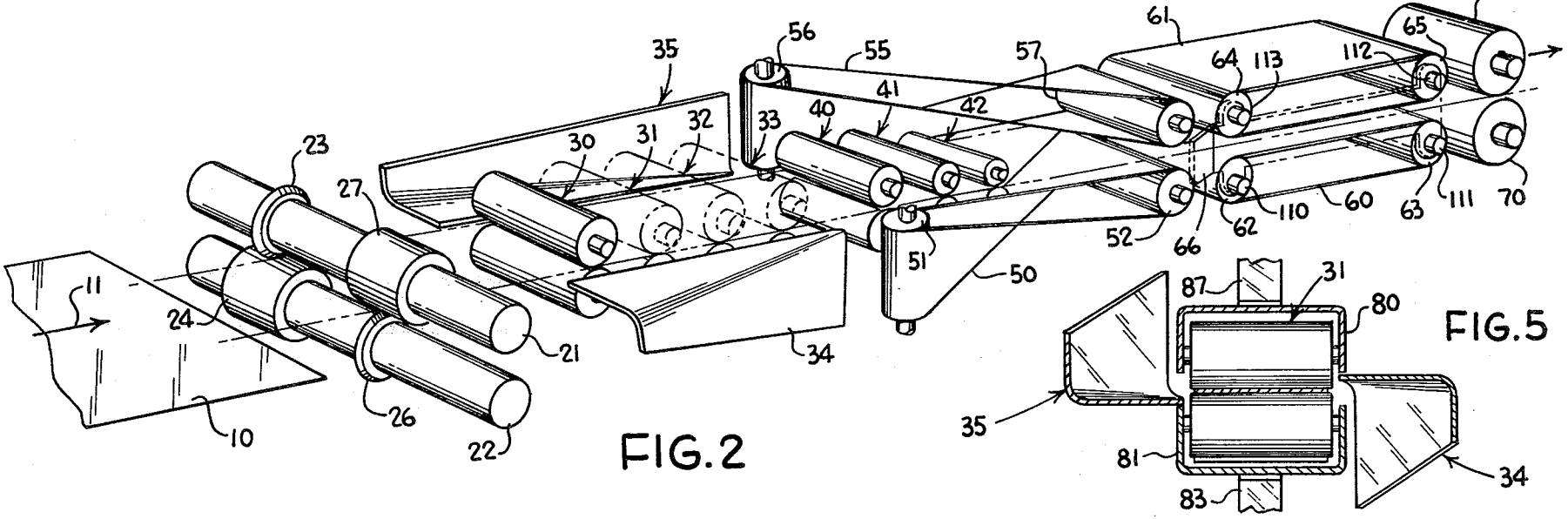
FIG. 2
FIG. 5

SHEET FOLDING DEVICE

BACKGROUND OF THE INVENTION

In high speed automatic mailing systems, wherein successive documents are prepared and then folded and inserted into envelopes, any intermittent movement required of the documents and/or envelope tends to lower the maximum speed or cyclic rate at which the system can operate. Thus, it is desirable to have the document handling components of the machine operate on a continuous, unidirectional basis so as to minimize the time and operational risks involved in starting and stopping the document movement.

SUMMARY OF THE INVENTION

The present invention provides a method and apparatus for scoring, folding and creasing documents as the latter continuously move in serial fashion along a substantially linear feed path, these three steps taking place on a continuous non-stop basis with respect to each successive document.

The primary object of the invention is to provide a novel method and apparatus for the high speed handling of documents, such as data terminal print-out letters, whereby such documents may be quickly, efficiently and reliably transferred from the printer to their associated mailing envelopes.

In the drawings

FIG. 1 is a perspective view illustrating sequential operations performed on a given sheet or document as the latter passes through the machine;

FIG. 2 is a schematic perspective view illustrating the general feed roll, sheet deflector plate and sheet deflector belt arrangement for the present folding equipment;

FIG. 5 is a sectional view taken along section line 5—5 of FIG. 3.

DETAILED DESCRIPTION OF THE INVENTION

Figure 3:
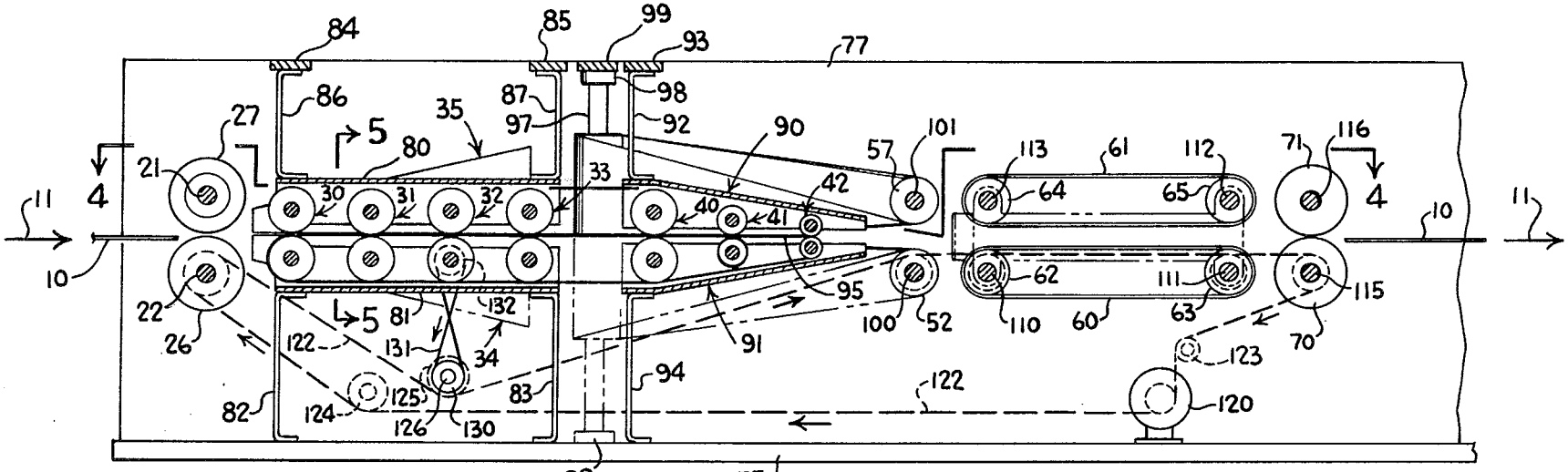
FIG. 3 is a side elevational view in partial section and shows the frame and other support means for the said feed roll and deflector components.

The present sheet folding method is diagrammatically illustrated in FIG. 1 wherein a single sheet 10 is shown in various configurations as it is operated on while continuously moving along a substantially straight linear feed path 11. Specifically, the sheet 10 is moved through a first station where it is formed with two scored lines 12 and 13 which weaken the sheet material along these lines thus facilitating folding the sheet along said lines. The score lines effectively establish three sheet panels 14, 15 and 16. As the center panel 15 continues its movement in a substantially horizontal plane, the end panels 14 and 16 are progressively laterally bent or deflected downwardly and upwardly, respectively, through approximately 90° and into vertical planes. Thereafter during continued sheet movement along said path, the said panels 14 and 16 are each deflected laterally through an additional 90 degrees so that an accordian sheet fold is produced wherein the sheets 14–16 are substantially superimposed on one another in horizontal planes. When properly longitudinally aligned with the direction of the feed path 11 the folded sheet is then progressively creased along its fold lines as is indicated at 12*a* and 13*a* so as to form a tight folded document that may be easily inserted or otherwise enclosed in an envelope or the like. It is to be understood that the sheet 10 in FIG. 1 has the various above described operations progressively performed thereon while the sheet remains in motion along said straight feed path 11.

In FIG. 2 there is schematically shown an exemplary apparatus for progressively supporting, conveying and bending or folding the sheet 10 as described in connection with FIG. 1. Along the feed path there is initially provided a sheet scoring means 20 which includes a pair of opposed driven shafts 21, 22 which carry a first rotary knife 23 and resilient cooperating rotary anvil 24, and a second rotary knife 26, and a cooperating resilient rotary anvil 27, the said knives and anvils being respectively rotatably secured to supporting shafts 21, 22 shown and being axially spaced so that as the sheet 10 passes between said shafts said knives and anvils will not only continue the feed action on said sheet but will also progressively form said score lines 12 and 13 on said sheets. After leaving the scoring means the leading edge of the center sheet panel 15 successively engages, and is continued to be supported and fed along path 11 by means of, a first series of four sets 30, 31, 32, 33 of cooperating feed rolls while the sheet panel 14 is laterally bent downwardly in end-to-end progression by a stationary curved deflector plate 34 and the sheet panel 16 is simultaneously and correspondingly, progressively, laterally bent upwardly by a similar curved deflector plate 35. The leading edge of the sheet panel 15 then successively engages, and is continued to be supported and fed by means of, a second series of three sets 40, 41 42 of cooperating feed rolls, the diameters of the feed rolls of each of these sets becoming progressively smaller, i.e., the diameters of the rolls of sets 41 and 42 are less than those of sets 40 and 41 respectively. While the sheet center panel moves through roll sets 40-42, the sheet panel 14 is further bent upwardly through 90 degrees into a horizontal plane in end-to-end progression by means of a twisted feed belt 50 which is operatively supported on, driven by and extends between a vertical roller 51 and a horizontal roller 52. Similarly the panel 16 is simultaneously progressively bent downwardly through 90° into a horizontal plane by means of another twisted belt 55 that is correspondingly supported on, driven by and extends between a vertical roller 56 and a horizontal roller 57. As will be apparent the belts 50 and 55 in being driven by their associated rollers will impose a longitudinal feeding action on the sheet panels 14 and 16 respectively and this feed action will supplement that of said feed roll sets 40–42, particularly at the downstream ends of the belt feed runs where no feed roll sets can be present to engage panel 15 in that the top and bottom panels 16 and 14 are now progressively closely approaching the top and bottom surfaces of panel 15 respectively.

As will be seen when the leading end of the sheet panel 15 emerges from between the downstream ends of said belts 50, 55, the sheet 10 will have been loosely folded; however, before final creasing is to be performed, the folded sheet is first moved between driven parallel aligning belts 60, 61 that are carried by rollers 62, 63 and 64, 65 respectively. The mutually adjacent runs of said belts 60, 61 are substantially parallel and disposed a relatively short distance apart so as to receive and continue the longitudinal feed movement of the loosely folded sheet 10 along said feed path 11. Disposed closely adjacent the sides of said mutually adjacent belt runs are opposed parallel aligning guides 66 and 67 which, if the longitudinal axis of the folded sheet is skewed, with respect to the feed path 11, serve to cam the sheet back into proper alignment so that the longitudinal axis thereof is parallel to the direction of said feed path 11. After leaving the belts 60, 61 the aligned folded sheet moves between the cooperating rolls 70, 71 so as to be thereby progressively tightly creased in end-to-end progression along said lines 12*a* and 13*a* illustrated in FIG. 1.

The sheet 10 continuously moves along the feed path 11 as it is being so scored, folded, aligned and creased; thus no inefficient sheet stops and starts have to be accommodated which might slow down the smooth progressive handling of each successive document or sheet as the latter moves along said path. It will be apparent that large numbers of serially fed sheets may be rapidly folded and otherwise similarly processed using the above described technique.

Figure 4:
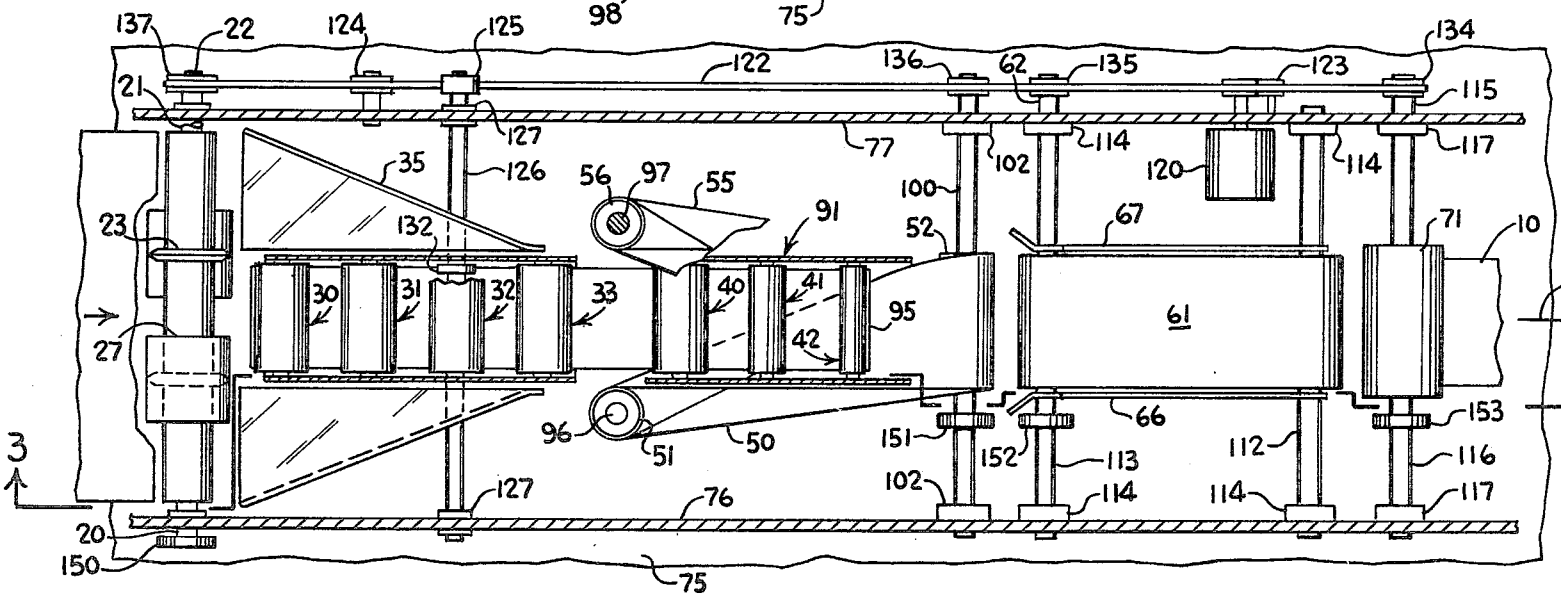
FIG. 4 is a plan view in partial section and shows the apparatus taken along section line 4-4 of FIG. 3.

Referring particularly to FIGS. 3–5 there is shown apparatus for supporting the various rolls, deflector plates, etc. described in connection with FIG. 2. On a base 75 there is mounted a pair of parallel side frame plates 76 and 77 which rotatably support by any suitable means the outer ends of said scoring roll shafts 21, 22. U-shaped brackets 80, FIG. 5, are provided which rotatably support the respective upper rolls of the said sets 30, 31, 32, 33, while the respective lower rolls of said sets are rotatably supported by a similar bracket 81. The lower U-shaped bracket 81 is secured to the base 75 by means of suitable support members 82 and 83, FIG. 3, while the upper U-shaped bracket 80 is secured to the cross braces 84 and 85 by means of suitable support members 86 and 87; said cross braces being fixed to and between the top edges of said frame side plates 76, 77.

The sheet panel deflector plates 34, 35 are respectively secured to said roll brackets 80 and 81 as is illustrated best in FIG. 5.

The respective upper rolls of roll sets 40, 41 and 42 are rotatably supported by a tapered inverted U-shaped bracket 90, FIG. 3, corresponding to bracket 80; while the respective cooperating lower rolls of said sets are rotatably supported by a similar tapered U-shaped bracket 91 which corresponds to said bracket 81. Bracket 90 is secured to the frame in cantilever fashion by means of a support member 92 that is fixed to a cross brace 93, FIG. 3, secured to and between the upper edges of said frame side plates 76, 77. Bracket 91 is secured to the machine base 75 in cantilever fashion by means of a support bracket 94. The roll sets 30-33 and 40-42 are mutually positioned such that their respective nips are disposed in a substantially common horizontal plane. A wide conveyor-type belt 95 extends around all the lower rolls of said roll sets, the upper run of said belt extending through each of said roll nips. In that there is a light compressive force between the said upper run of the belt 95 and each of upper and lower rolls of each roll set, all the roll sets may be driven by driving the belt by means of one of the rolls in one of said sets; e.g., the lower roll of set 32, as indicated in FIG. 3. Thus each upper roll of said roll sets may, in cooperation with belt 122, serve to drive a sheet therebetween along the feed path 11.

The said vertically disposed deflecting belt supporting rolls 51, 56 are secured to vertical shafts 96, 97 respectively which are rotatably supported by suitable bearings 98 carried by the machine base 75 and a cross brace 99 that is secured to and between the upper edges of said frame side plates 76, 77. The cooperating horizontal belt supporting rolls 52, 57 are secured to shafts 100, 101 respectively which are rotatably supported by suitable bearings 102 carried by the side plates 76, 77. The horizontal rolls 62, 63, 64, 65 for the sheet aligning belts 60, 61 are secured to shafts 110, 111, 113 and 112 respectively which are rotatably supported by suitable bearings 114 carried by said side plates 76, 77. The said lateral aligning guide plates 66, 67 are carried by said shafts 62–65; the upstream ends of said plates being flared slightly as indicated in FIG. 4 so as to facilitate the entry and aligning of the accordion folded sheet therebetween as the latter moves along said feed path 11. The creasing rolls 70, 71 are secured to shafts 115 and 116 respectively which are rotatably supported by suitable bearings 117 carried by said side plates 76, 77.

The drive system for the present apparatus includes an electric motor mounted on the base 75, said motor having a drive pulley 121 secured to the shaft thereof. Cooperating with pulley 121 is a long closed loop belt 122. First and second idler pulleys 123, 124, FIG. 3, are rotatably carried in a conventional manner on the outside of side plate 77 as shown in FIG. 4. A drive pulley 125, FIG. 4, is secured to a cross shaft 126 that is rotatably supported by suitable bearings 127 carried by said plates 76, 77. Also secured to shaft 126 is a second pulley 130 over which is entrained a crossed drive belt 131 that is also entrained over a pulley 132, FIG. 3, that is suitably secured to the lower roll of said roll set 32. As is best illustrated in FIGS. 3 and 4 the main belt 122 is entrained over said idler pulley 123, and then over suitable pulleys 134, 135, 136, FIG. 4, secured to shafts 115, 62 and 100, respectively, then over said drive pulley 125, then over a pulley 137, FIG. 4 secured to said shaft 22, and finally over said idler pulley 124 and the motor pulley 121. The scoring rolls may be geared together by any suitable gear means designed at 150, FIG. 4, while shafts 62 and 64, the shafts 100 and 101, and shafts 115 and 116 may be similarly geared together respectively by any suitable similar gear means designated at 151, 152 and 153 of FIG. 4, respectively. All of the pulleys engaged by belt 122 are arranged so as to be disposed in a common vertical plane. As will be seen this power train will serve to drive the above described scoring rolls 26, 27, the roll sets 30–33, 40–42 with belt 95, the sheet deflector belts 50, 55, the sheet aligning belts 60, 61 and the creasing rolls 70, 71; this drive action being continuous so that a sheet 10 to be processed may be smoothly and progressively folded as previously described as it moves through the machine along said feed path 11.

What is claimed is:

1. A method of folding successive sheets, comprising the steps of:

continuously feeding a sheet in a given direction along a predetermined linear path;

progressively scoring said sheet as the latter moves along said path; said scoring taking place to form two substantially parallel score lines that are substantially parallel to the direction of feed movement of said sheet along said linear path so as to thereby define two outermost sheet panels and a central panel;

laterally bending the two resultant outermost panels in opposite directions relative to the plane of the central panel through substantially 180 degree angles so as to thereby form a three-panel accordian folded sheet as said sheet continues to move along said linear path;

continuing feeding said sheet in said given direction along said predetermined path after said bending; and creasing the folded sheet in end-to-end progression along said score lines as said sheet moves along said continuous linear path.

2. Apparatus for progressively folding successive sheets comprising:

first means for continuously feeding a sheet along a predetermined linear path;

sheet scoring means positioned along said linear path so as to progressively form a pair of parallel sheet score lines that extend substantially parallel to the direction of feed movement of said sheet and thus form a central panel intermediate two outermost panels;

a camming means positioned along said path and downstream from said scoring means for laterally bending said outermost panels formed by said score lines in opposite directions relative to the plane of the central panel about said lines respectively in end-to-end progression so as to thereby progressively form a three panel accordian fold during the feed movement of said sheet; and creasing means disposed along said path and downstream from said camming means for creasing said sheet in end-to-end progression along said score line as said sheet moves along said linear path, so as to thereby form a multi-panelled folded sheet.

3. Apparatus as defined by claim 2 wherein said camming means includes a stationary set of cam members that are adapted to progressively laterally bend one of said panel through approximately 90°.

4. Apparatus as defined by claim 2 wherein camming means includes a pair of opposed cooperatively arranged conveyor belts that progressively laterally bend one of said panels through approximately 90°.

5. Apparatus as defined by claim 2 additionally comprising a folded sheet aligning means for realigning said folded sheet in its feed direction in the event that during said lateral bending action the said score lines become misaligned with respect to the said direction of feed movement of said sheet.

* * * * *